US010758442B2

(12) United States Patent
Panigada

(10) Patent No.: US 10,758,442 B2
(45) Date of Patent: Sep. 1, 2020

(54) DEVICE FOR POSITIONING A BEDRIDDEN PATIENT

(71) Applicant: FONDAZIONE IRCCS CA' GRANDA-OSPEDALE MAGGIORE POLICLINICO, Milan (IT)

(72) Inventor: Mauro Panigada, Milan (IT)

(73) Assignee: FONDAZIONE IRCCS CA' GRANDA-OSPEDALE MAGGIORE POLICLINICO, Milan (IT)

( * ) Notice: Subject to any disclaimer, the term of this patent is extended or adjusted under 35 U.S.C. 154(b) by 0 days.

(21) Appl. No.: 15/558,909

(22) PCT Filed: Feb. 26, 2016

(86) PCT No.: PCT/IB2016/051052
§ 371 (c)(1),
(2) Date: Sep. 15, 2017

(87) PCT Pub. No.: WO2016/147070
PCT Pub. Date: Sep. 22, 2016

(65) Prior Publication Data

US 2018/0078437 A1 Mar. 22, 2018

(30) Foreign Application Priority Data

Mar. 16, 2015 (IT) ..... MI2015A0395

(51) Int. Cl.
*A61G 7/07* (2006.01)
*A61G 7/075* (2006.01)

(52) U.S. Cl.
CPC ..... *A61G 7/07* (2013.01); *A61G 7/072* (2013.01); *A61G 7/075* (2013.01); *A61G 7/0755* (2013.01)

(58) Field of Classification Search
CPC ..... A47C 20/021; A47C 20/00; A47C 20/023; A47C 20/025; A47C 20/027; A47C 20/02; A47G 9/10
See application file for complete search history.

(56) References Cited

U.S. PATENT DOCUMENTS 2,938,570 A * 5/1960 Flajole ..... A47C 27/081 137/861
3,308,489 A * 3/1967 Winkler ..... A61G 7/0755 5/648

(Continued)

FOREIGN PATENT DOCUMENTS

EP 2 024 117 B1 11/2012
WO 99/66873 A1 12/1999

OTHER PUBLICATIONS

International Search Report and Written Opinion of the International Searching Authority for corresponding International Patent Application No. PCT/IB2016/051052 dated Jun. 10, 2016, 9 pages.

*Primary Examiner* — Peter M. Cuomo
*Assistant Examiner* — Ifeolu A Adeboyejo
(74) *Attorney, Agent, or Firm* — Merchant & Gould P.C.

(57) ABSTRACT

A device is for positioning a bedridden patient, in particular for keeping the lateral Trendelenburg position or another safety position. In particular, a medical device includes at least a first shaped pillow (1) adapted to support a patient's back and to keep the patient in a lateral position with a predetermined inclination angle. The pillow (1) can be extended in width along a lateral direction (L2) so as to tailor the pillow to the patient's body size.

20 Claims, 3 Drawing Sheets

(56) References Cited

U.S. PATENT DOCUMENTS 3,644,949 A * 2/1972 Diamond ..... A47C 20/04 5/630
3,829,917 A * 8/1974 De Laittre ..... A47G 9/109 5/636
5,154,649 A * 10/1992 Pender ..... A47D 13/083 5/490
5,189,748 A * 3/1993 Garrison ..... A47D 13/08 5/603
5,269,323 A * 12/1993 Krouskop ..... A47C 20/021 5/632
5,345,630 A * 9/1994 Healy ..... A47C 20/048 137/270
5,448,790 A * 9/1995 Saro ..... A47C 17/045 5/427
5,815,863 A * 10/1998 Dolisi ..... A47C 20/021 5/632
6,009,873 A * 1/2000 Neviaser ..... A47C 20/027 128/845
6,047,419 A 4/2000 Ferguson
6,154,903 A * 12/2000 Wai-Chung ..... A47C 20/026 5/632
6,442,779 B1 * 9/2002 LeVert ..... A47C 4/54 5/648
7,069,609 B2 * 7/2006 Zheng ..... A47C 4/54 5/644
7,328,472 B2 * 2/2008 Chaffee ..... A47C 7/021 5/655.3
7,454,808 B2 * 11/2008 Parrilla ..... A47C 7/546 5/632
7,681,266 B2 * 3/2010 Gerlach ..... A47D 7/01 5/632
7,909,787 B2 * 3/2011 Ravikumar ..... A61G 7/0755 602/13
7,966,679 B2 * 6/2011 Sakata ..... A63B 21/00047 482/142
8,136,186 B1 * 3/2012 Leach ..... A47C 20/025 5/631
8,572,780 B1 * 11/2013 Watters ..... A47G 9/1054 5/490
8,671,480 B1 * 3/2014 Leach ..... A47C 20/025 5/630
9,381,107 B2 * 7/2016 MacLeod ..... A61F 5/3769
9,545,155 B2 * 1/2017 James ..... A47C 3/16
2004/0060117 A1 * 4/2004 Chan ..... A47D 13/08 5/655
2005/0060806 A1 * 3/2005 Wilkinson ..... A47C 20/021 5/632
2005/0229315 A1 * 10/2005 Walpin ..... A47C 20/027 5/633
2007/0107131 A1 * 5/2007 Fux ..... A47C 7/383 5/636
2009/0222991 A1 9/2009 Davis, III
2010/0078033 A1 4/2010 Aikman
2010/0146708 A1 * 6/2010 Sakata ..... A63B 21/00047 5/655.3
2010/0281617 A1 * 11/2010 Brun ..... A47C 20/02 5/632
2012/0144591 A1 * 6/2012 Mobley ..... A61G 13/121 5/640
2013/0198962 A1 * 8/2013 Melcher ..... A47C 20/00 5/652
2014/0041125 A1 * 2/2014 Grealy ..... A47G 9/1027 5/655.3
2014/0215719 A1 * 8/2014 Gibbons ..... A47C 20/025 5/632
2015/0282630 A1 * 10/2015 McIntyre ..... A47C 20/048 5/660

* cited by examiner

DEVICE FOR POSITIONING A BEDRIDDEN PATIENT

This application is a National Stage Application of PCT/IB2016/051052, filed 26 Feb. 2016, which claims benefit of Ser. No. MI2015A000395, filed 16 Mar. 2015 in Italy and which applications are incorporated herein by reference. To the extent appropriate, a claim of priority is made to each of the above disclosed applications.

The present invention relates to a device for positioning a bedridden patient, in particular for keeping the lateral Trendelenburg position or another safety position.

BACKGROUND ART

So-called VAP (Ventilator-Associated Pneumonia) is the complication most frequently associated with tracheal intubation and mechanical ventilation in patients hospitalized in intensive care.

Preliminary studies on animal models have shown that the orientation of the trachea and the tracheal tube under the horizontal plane prevents the onset of VAP with respect to the currently recommended orientation by at least 30°. In adults, the trachea and the endotracheal tube may be kept under the horizontal plane by means of the lateral Trendelenburg position.

At least four pillows are normally used by nursing staff in order to keep the lateral Trendelenburg position. Such a position is difficult to be kept because the sedated patient with muscular relaxation tends to spontaneously take the supine position. This requires continuous assistance by nurses to reposition the patient. Furthermore, the tailoring of the pillows to the needs of different patients, in particular to their body size, requires particular attention and considerable experience of the health care staff.

A further difficulty arises from the need to turn the patient onto the other side at regular intervals, which requires a complete rearrangement of all pillows.

A problem addressed by the present invention is thus that of providing a medical device which simplifies the operations of positioning and repositioning a bedridden patient and keeping him/her in the Trendelenburg position or in a similar safety position.

SUMMARY OF THE INVENTION

These and other problems are solved by a medical device as set forth in the appended claims, the definitions of which form an integral part of the present description.

Therefore, a subject of the invention is a medical device comprising at least one shaped pillow adapted to keep a patient in a lateral position with a predetermined inclination angle and characterized in that it can be extended laterally in width so as to tailor it to the patient's body size.

A second subject of the invention is a medical device comprising a back supporting pillow as and at least one pillow chosen from a pillow for the patient's head and a pillow for the patient's legs, where said pillows are joined together by removable connection means.

Another subject of the invention is a kit comprising at least two pillows, and the at least one other pillow is a leg pillow or a head pillow.

A yet further subject of the invention is a kit comprising pillows and removable connection strips to keep said pillows joined together when used on the patient.

BRIEF DESCRIPTION OF THE DRAWINGS

Further features and advantages of the present invention will become apparent from the description of some embodiments, given below by way of non-limiting example, with reference to the following figures.

DETAILED DESCRIPTION OF THE INVENTION

Figure 1:
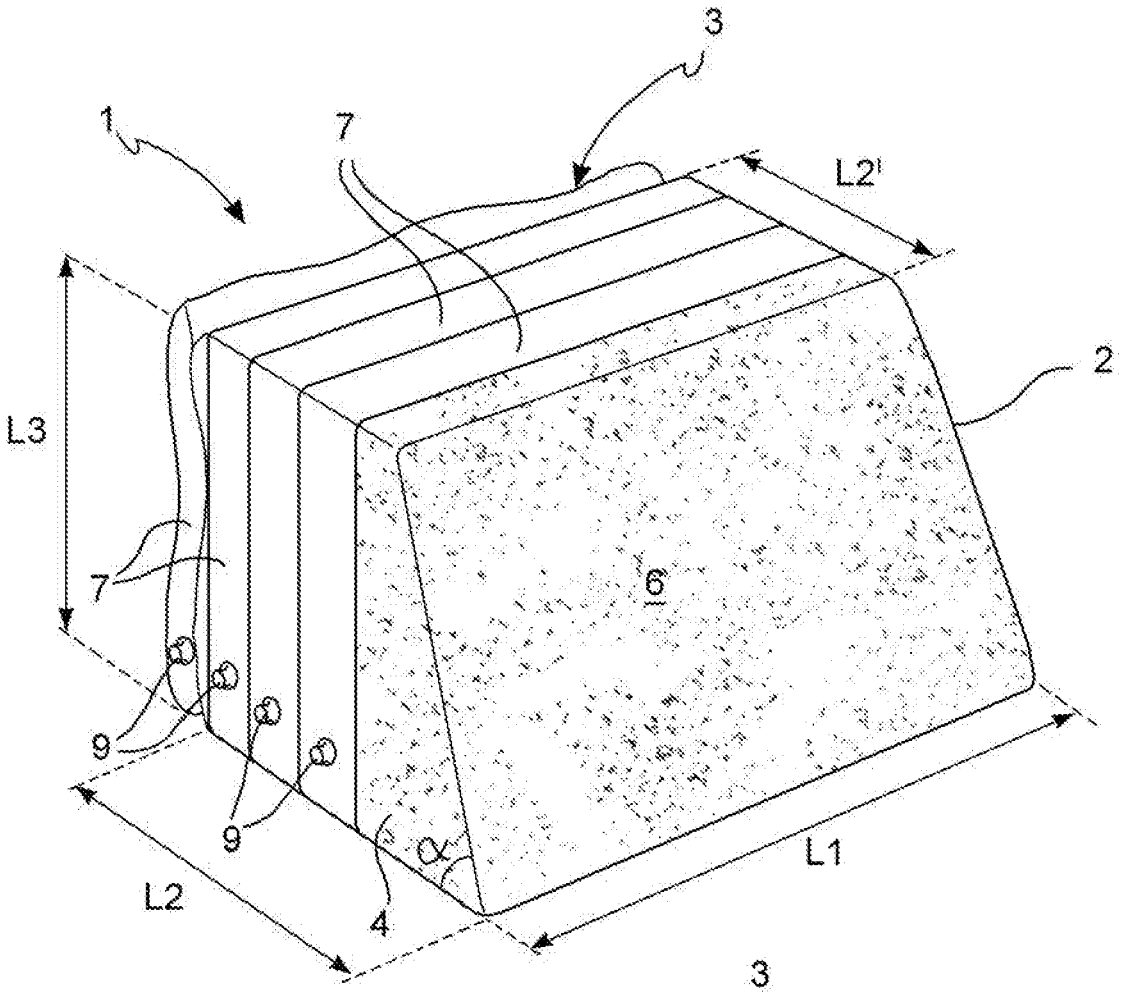
FIG. 1 is a perspective view of a shaped pillow according to the invention.
Figure 2:
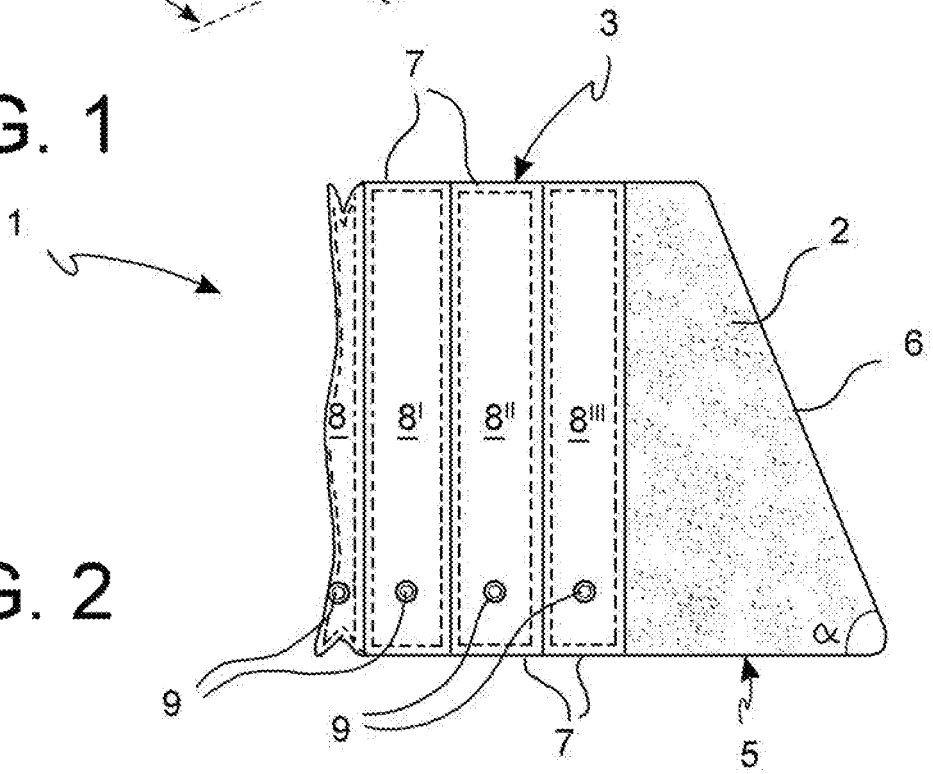
FIG. 2 is a side phantom view of the pillow in FIG. 1.

With reference to the figures, the shaped pillow of the invention, indicated by reference numeral 1 as a whole, comprises a shaped portion 2 and an expandable portion 3.

Pillow 1 develops along three directions:

- a first longitudinal direction L1 (length), substantially parallel to the patient's body;
- a second lateral direction L2 (width), substantially traversal to the patient's body, and
- a third vertical direction L3 (height).

The shaped portion 2 is shaped so that the width L2' at the level of the upper surface of pillow 1 is less than the width L2 at its base.

The shaped portion 2 consists of a body 4 having a rectangular base 5 and a substantially right-angled triangle shaped cross section. Therefore, body 4 has an inclined surface 6. Surface 6 forms the support surface for the patient's back.

In preferred embodiments, the inclination of surface 6 with respect to base 5 (angle $\alpha$ in the figures) is from 20° to 40°, or from 25° to 35°, or about 30°. It has been noted that such an inclination angle ensures a better position for the patient.

The shaped portion 2 is made of a flexible material so as to be soft and accommodating and not to create abrasions for the patient.

In preferred embodiments, the material of the shaped portion 2 of pillow 1 is an elastomer, in particular a foam elastomer. For example, natural or synthetic rubber or a viscoelastic foam, in particular of the bedsore-prevention type, may be used. In certain embodiments, such a material may be a latex, e.g. of the memory shape type.

At least the shaped portion 2, or only the support surface 6 thereof, is preferably covered with a breathable fabric, such as cotton, flax or other fabric used in the medical field. In some embodiments, a synthetic fabric will be used, such as an acrylic fiber fabric or a knitted pile fabric of the "Spandex" type.

In some embodiments, at least the shaped portion of pillow 1 or, if used, the fabric coating thereof, comprises an antibacterial compound, such as for example an antibacterial active compound either absorbed, adhered or bound to the surface thereof by means of covalent bonds.

Examples of antibacterial active compounds are penicillins, aminoglycosides, quinolone antibiotics, tetracyclines, chloramphenicol, sulfacetamide, sulfamethazine, sulfadiazine, sulfamerazine, sulfamethizole, erythromycin, clarithromycin, rifamycin, rifampicin, ceftazidime, amoxicillin, amoxicillin trihydrate, clavulanic acid, vancomycin hydrochloride, teicoplanin, linezolid, colistin and chlorhexidine. For example, such compounds may be bound to the surface to be treated by means of cyclodextrins, according to technologies known to those skilled in art.

In other embodiments, the antibacterial compound either comprises or consists of $Ag^+$ ions. For example, a silver yarn or an organometallic complex may be used, in which $Ag^+$ is coordinated. Examples of complexes of this type are described in EP 2 024 117 B1 to NM TECH LTD NANOMATERIALS.

In some embodiments, the antibacterial compound is based on bioactive synthetic polymers and natural protein substances with positive charges.

The expandable portion 3 of pillow 1 comprises one or more sections 7 (four sections 7 in the figure). When the sections 7 are more than one, they are separated from one another so as to create a series of expandable modules, each being able to be expanded by a suitable inflation fluid, so as to adjust the thickness of pillow 1 along the lateral direction L2 according to needs. Indeed, it is known that according to the patient's body size and the size of the bed on which the patient is laying, it may be necessary to modify the size, in particular the lateral dimensions, of pillow 1 in order to obtain an appropriate support. Indeed, the pillow must be arranged so as to be supported between the patient's back and the bed containment barriers, so as to remain fixed in place, whereby the void may vary as a function of the indicated parameters.

For this purpose, each section 7 internally comprises a chamber 8, 8', 8", 8'", connected to the outside by a spout 9, for the inflation fluid to enter. A check valve is preferably arranged at spout 9. The chambers 8, 8', 8", 8'" may also comprise a second valve (not shown) for draining the inflation fluid, or the valve associated with spout 9 may be a charging/discharging valve actuatable on command.

Figure 3:
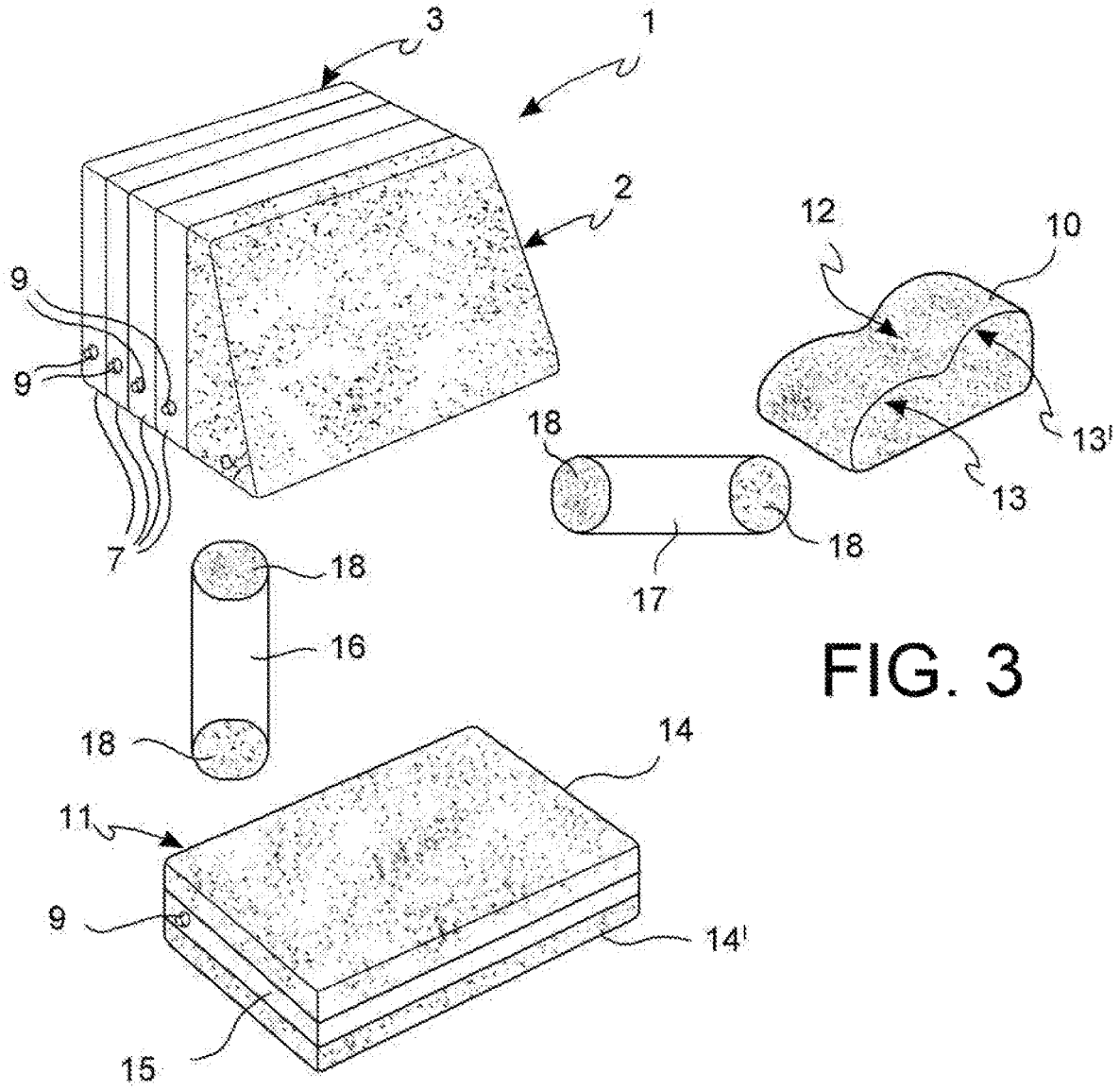
FIG. 3 is a perspective view of a kit comprising the pillow of the invention.

FIG. 3 shows a kit comprising the pillow 1 according to the invention, a second pillow 11 to be placed between the patient's legs, and a third pillow 10 for the patient's head.

Figure 4:
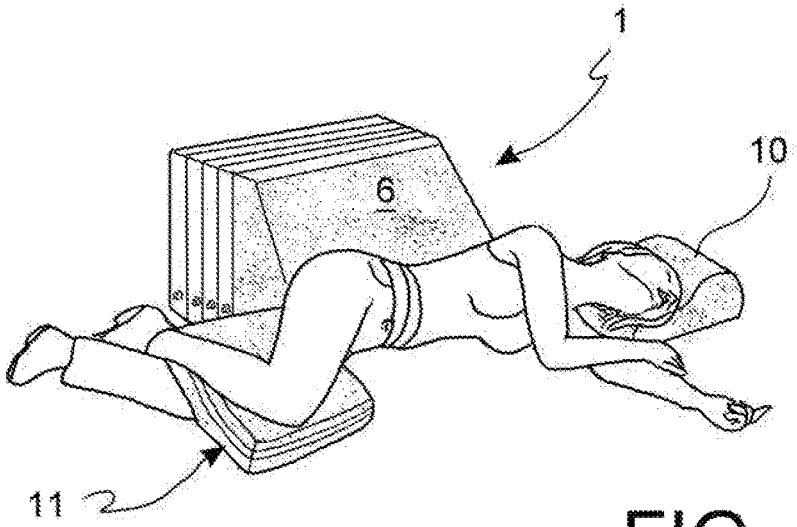
FIG. 4 is a perspective view of the kit of the invention in use on a patient.

The shape of the third pillow 10 is such as to ensure an adequate support to the patient's head, in particular in the Trendelenburg position which involves a downward inclination (negative inclination) of about 5°. Therefore, pillow 10 has a double hump shape 13, 13' which has a middle depression 12 such as to allow the desired negative inclination (FIG. 4).

Figure 5:
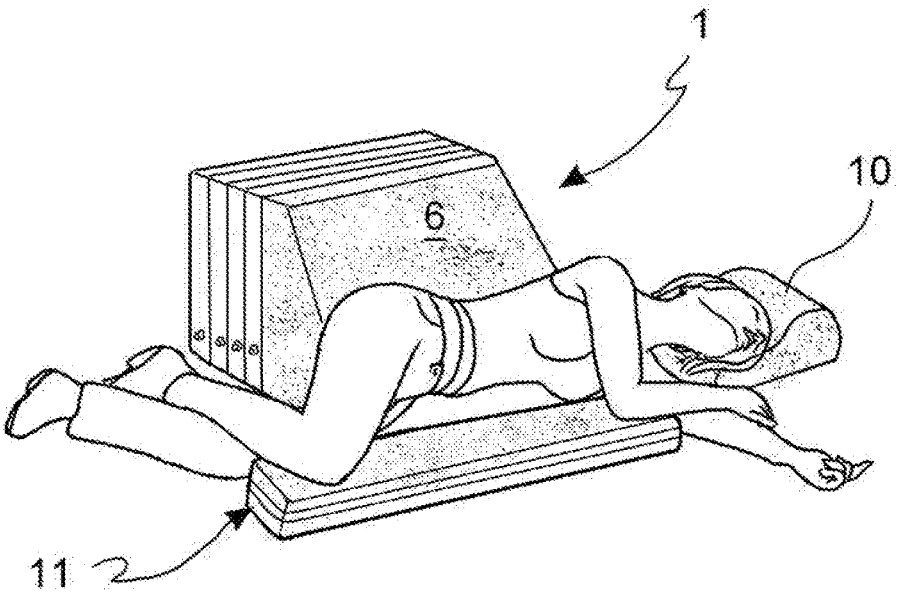
FIG. 5 is a perspective view of the kit of the invention in use on a patient according to a different embodiment.
Figure 6:
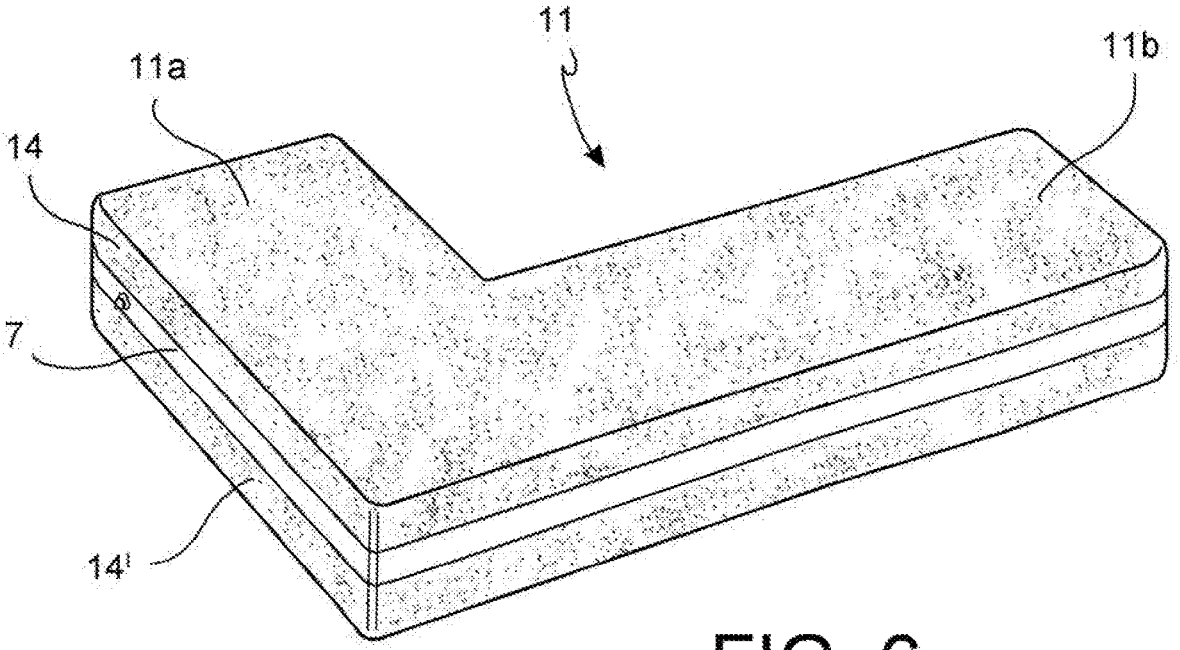
FIG. 6 is a perspective view of a pillow for legs and arms according to a further embodiment.

As shown on the drawing, the second pillow 11 may have a classic parallelepiped shape, but in other embodiments it may be circular, elliptical or have a different shape. Pillow 11 is placed between the patient's legs as shown in FIG. 4 or under the knee and the upper elbow as shown in FIG. 5, so as to support the knee and the upper elbow. For this purpose, the size of pillow 11 may be different according to different needs: wider and shorter in the case shown in FIG. 4, narrower and longer in the case shown in FIG. 5. Furthermore, in the latter case, pillow 11 may have a wider first portion 11*a* to support the leg and a narrower second portion 11*b* to support the arm without interfering with the patient's torso (FIG. 6).

In some embodiments, as shown in the figures, pillow 11 may also comprise at least one support portion 14, 14' and at least one expandable portion 15. Two support portions 14, 14' sandwiching the expandable portion 15 on the two sides thereof are shown in the figures, but in other embodiments a single support portion 14 may be provided.

The expandable portion 15 is similar to the expandable portion 3 of the first pillow 1, but will preferably consist of a single section 7 in which the chamber 8 for the inflation fluid is housed.

A spout 9 with check valve and charging/discharging valve is also included for the second pillow 11. In the first case, a valve (not shown) for discharging the fluid will be obviously included.

In some embodiments, the support portion(s) 14, 14' are made of the same material as the support portion 2 of the first pillow 1 and may be similarly coated with a breathable fabric like those described above, possibly comprising an antibacterial compound as defined above.

The inflation fluid may be a gas or a liquid, preferably sterile and non-flammable.

In the case of a gas, any means may be included for inflating the chambers 8, such as a manual pump, a compressed air generator or a compressed air line, or a line of another fluid, having a pressure higher than atmospheric pressure.

An inert, non-flammable gas will be preferably used, such as for example nitrogen.

If the inflation fluid is a liquid, typically water, an appropriate pump will be used, which will both introduce the fluid and remove it at the end of use. Typically, the inflation liquid will be recycled. In such a case, it will preferably contain sanitizing substances.

The kit in FIG. 3 may further comprise a first connection strip 16 between the first pillow 1 and the second pillow 11 and a second connection strip 17 between the first pillow 1 and the third pillow 10.

The connection strips 16, 17 may be made of natural, artificial or synthetic fabric and are preferably removable (as shown in the figures). For this purpose, the strips 16, 17 comprise removable connection means 18 at the two ends, in particular the male portion or the female portion of a hook and loop system (known as Velcro® system), the complementary female or male portion being arranged on the lower surface of the pillows 1, 10, 11. With regard to the second pillow 11 for the patient's legs, such a complementary portion of the connections means will be positioned in a point to prevent the interference with the patient's body so as to ensure maximum comfort.

It is worth noting that the above-described hook and loop system is only one example of removable connection means 18. Other examples may be hook and eyelet systems, automatic buttons, magnetic coupling systems or the like.

The advantages of the pillows according to the invention and of the corresponding kit are apparent and already highlighted in part.

The first pillow 1 and the second pillow 11 comprise expandable modular portions, so as to adjust the width or thickness of the pillow, respectively, according to needs, i.e. as a function of the bed size and of the patient's body.

The removable connection means between the three pillows of the kit allow to keep them joined, making it easier to position them on the patient and keep him/her in the desired position. Indeed, the connection means avoid the leg pillow 11 from being inadvertently moved by the patient, thus altering the correct support position, for example. On the other hand, the fact that such connection means are removable facilitates the later storage of the kit in a cabinet or other container, by limiting the dimensions thereof.

As apparent from the shape of the pillows, the pillow kit according to the invention may be used for the patient resting either on the left or on the right side, which operation must be performed at regular intervals for a bedridden patient in the described conditions.

It is apparent that only some particular embodiments of the present invention have been described, to which those skilled in the art will be able to make all the changes required to adapt it to particular applications, without thereby departing from the scope of protection of the present invention.

The invention claimed is:

1. A medical device comprising at least a first shaped pillow adapted to support a patient's back when the patient lies on a side, and to keep the patient in a side position with a predetermined inclination angle, wherein said pillow comprises a base, a top surface, a first surface, and a second surface opposite the first surface and defining a pillow width between the first surface and the second surface; the first surface comprising a shaped portion having an inclined surface with an angle of 20° to 40° relative to the base; and wherein the pillow comprises a plurality of connected expandable modules at the second surface, the connected expandable modules expandable along a direction of the pillow width transverse to the first surface and the torso of the patient supported on the pillow, to vary the pillow width and to tailor said pillow to a patient's body size.

2. The medical device according to claim 1, further comprising a second pillow to support a patient's leg, and a third pillow to support the patient's head.

3. The medical device according to claim 1, wherein the shaped portion comprises a body having a rectangular base and a cross section substantially right-angled triangle-shaped.

4. The medical device according to claim 1, wherein the inclination of the first surface with respect to the base ranges between an angle $\alpha$ of 25° and 35°.

5. The medical device according to claim 1, wherein the plurality of expandable modules are fluidly separated from one another, so as to create a series of expandable modules along the lateral direction, each of the expandable modules being able to be expanded by inflation fluid, so as to adjust the thickness of the pillow along the lateral direction according to needs.

6. The medical device according to claim 5, wherein each section comprises internally a chamber, connected to outside of the pillow by a spout, for inlet of the inflation fluid.

7. The medical device according to claim 6, wherein a check valve is arranged at the spout, and wherein the chambers comprise a second valve for discharge of the inflation fluid, or, the valve associated with the spout is a charging/discharging valve actuatable upon a command.

8. The medical device according to claim 2, wherein the second pillow has a parallelepiped, circular or elliptical shape, or the second pillow has a first portion with a larger width for supporting the leg, and a second portion with a smaller width for supporting the arm without interfering with the patient's torso.

9. The medical device according to claim 2, wherein the pillow comprises at least one support portion, said expandable modules comprising at least one section in which a chamber is housed, in flow communication with outside of the pillow by a spout.

10. The medical device according to claim 2, wherein said shaped portion and said at least one support portion are made of a flexible material or of an elastomer or of an elastomeric foam.

11. The medical device according to claim 2, wherein at least the shaped portion and/or the at least one support portion or only the support surface thereof are coated with a breathable fabric, comprising cotton, flax, or other fabric used in the medical field.

12. The medical device according to claim 11, wherein at least the shaped portion or the at least one support portion or, where used, the fabric coating thereof, comprise an antibacterial compound or an antibacterial active compound absorbed, adhered or bound by covalent bonds or cyclodextrins to said surface.

13. The medical device according to claim 12, wherein said antibacterial compound or antibacterial active compound is selected from penicillins, aminoglycosides, quinolone antibiotics, tetracyclines, chloramphenicol, sulfacetamide, sulfamethazine, sulfadiazine, sulfamerazine, sulfamethizole, erythromycin, clarithromycin, rifamycin, rifampicin, ceftazidime, amoxicillin, amoxicillin trihydrate, clavulanic acid, vancomycin hydrochloride, teicoplanin, linezolid, colistin, chlorhexidine and $Ag^+$ ions.

14. The medical device according to claim 1, wherein the third pillow has two bumps, separated by a middle depression, the middle depression configured to place a patient's head in a declination of about 5° below a horizontal plane.

15. The medical device according to claim 5, wherein the inflation fluid is a gas or a liquid, and the inflation fluid is inflammable and/or sterile.

16. The medical device according to claim 2, comprising a third pillow and a first removable connection strip between the first pillow and the second pillow and a second removable connection strip between the first pillow and the third pillow.

17. The medical device according to claim 16, wherein the connection strips comprise, at two ends, removable connectors comprising: a male portion or a female portion of a hook and loop system, the complementary female or male portion being arranged on the base of the pillows, or hook and eyelet systems, automatic buttons, or magnetic coupling systems.

18. A medical device comprising at least a first shaped pillow, wherein the first shaped pillow comprises a base surface, a top surface, an inclined first face, and an opposing second face, the first face and the second face defining a pillow width between the first face and the second face, wherein the inclined first face has an angle of 20° to 40° relative to the base surface, and a plurality of connected expandable modules extending from the opposing second face, the connected expandable modules being expandable along a direction of the pillow width transverse to the first face to vary the pillow width and tailor the pillow to a patient's body size; and a second pillow comprising two humps, separated by a middle depression.

19. The medical device according to claim 18, wherein the expandable modules are configured to engage a barrier of a bed.

20. The medical device according to claim 1, wherein the expandable modules are configured to engage a barrier of a bed.

* * * * *